US011459530B2

(12) United States Patent
Bazanov et al.

(10) Patent No.: US 11,459,530 B2
(45) Date of Patent: Oct. 4, 2022

(54) SOLUTION FOR REMOVING VARIOUS TYPES OF DEPOSITS FROM A SURFACE

(71) Applicant: ANGARA INDUSTRIES LIMITED, London (GB)

(72) Inventors: Daniil Romanovich Bazanov, Samara (RU); Stanislav Georgievich Betser, Korolev (RU); Viktor Ivanovich Semenikhin, Moscow (RU)

(73) Assignee: ANGARA INDUSTRIES LIMITED, London (GB)

( * ) Notice: Subject to any disclaimer, the term of this patent is extended or adjusted under 35 U.S.C. 154(b) by 0 days.

(21) Appl. No.: 16/957,824

(22) PCT Filed: Dec. 3, 2018

(86) PCT No.: PCT/RU2018/050154

§ 371 (c)(1),
(2) Date: Jun. 25, 2020

(87) PCT Pub. No.: WO2019/132735

PCT Pub. Date: Jul. 4, 2019

(65) Prior Publication Data

US 2021/0062113 A1 Mar. 4, 2021

(30) Foreign Application Priority Data

Dec. 26, 2017 (RU) ..... 2017146009

(51) Int. Cl.

| | |
|---|---|
| ***C11D 1/14*** | (2006.01) |
| ***C11D 1/29*** | (2006.01) |
| ***C11D 3/04*** | (2006.01) |
| ***C11D 3/395*** | (2006.01) |
| ***C11D 3/39*** | (2006.01) |
| ***B08B 3/08*** | (2006.01) |
| ***C11D 1/83*** | (2006.01) |
| ***C11D 3/00*** | (2006.01) |
| ***C11D 3/33*** | (2006.01) |
| ***C11D 3/34*** | (2006.01) |
| ***C11D 3/37*** | (2006.01) |
| ***C11D 3/36*** | (2006.01) |
| ***C11D 1/72*** | (2006.01) |
| ***C11D 3/32*** | (2006.01) |
| *C11D 1/22* | (2006.01) |
| *C11D 1/722* | (2006.01) |

(52) U.S. Cl.

CPC ..... *C11D 3/3942* (2013.01); *B08B 3/08* (2013.01); *C11D 1/72* (2013.01); *C11D 1/83* (2013.01); *C11D 3/0026* (2013.01); *C11D 3/0073* (2013.01); *C11D 3/32* (2013.01); *C11D 3/33* (2013.01); *C11D 3/3418* (2013.01); *C11D 3/361* (2013.01); *C11D 3/373* (2013.01); *C11D 3/3905* (2013.01); *C11D 3/3932* (2013.01); *C11D 3/3937* (2013.01); *C11D 1/146* (2013.01); *C11D 1/22* (2013.01); *C11D 1/721* (2013.01); *C11D 1/722* (2013.01)

(58) Field of Classification Search

CPC .. C11D 1/22; C11D 1/72; C11D 1/722; C11D 3/361; C11D 3/32; C11D 3/33; C11D 3/3905

USPC ..... 510/235, 238, 247, 255, 311, 376, 467, 510/477, 488, 499, 505, 506

See application file for complete search history.

(56) References Cited

U.S. PATENT DOCUMENTS

| | | | | |
|---|---|---|---|---|
| 8,815,789 | B2 * | 8/2014 | Tetard | C11D 3/28 510/311 |
| 11,001,791 | B2 * | 5/2021 | Sheptunov | C11D 3/33 |
| 2008/0000032 | A1 * | 1/2008 | Wieprecht | C11D 11/0023 8/111 |

(Continued)

FOREIGN PATENT DOCUMENTS

| | | | | |
|---|---|---|---|---|
| RU | 2639433 | C2 * | 12/2017 | C11D 3/361 |
| WO | WO-2017180026 | A1 * | 10/2017 | B08B 3/04 |

OTHER PUBLICATIONS

English Language Machine Translation of RU0263433 (Year: 2017).*

*Primary Examiner* — Gregory R Delcotto
(74) *Attorney, Agent, or Firm* — Nixon & Vanderhye, P.C.

(57) ABSTRACT

The invention relates to the field of removing various types of deposits from a surface, specifically to means for cleaning metallic and ceramic surfaces of industrial equipment, and can be used for removing deposits, such as oxides of metals (iron, chromium, nickel, etc.), carbonate and salt deposits, asphaltene-resin-paraffin deposits and deposits of a petroleum nature, and deposits of an organic and biological deposits. The proposed solution for removing various types of deposits contains hydrogen peroxide, complexone, an anti-foaming agent, water-soluble calixarene and water in the following ratio: hydrogen peroxide, a catalyst for decomposing peroxide compounds, an antifoaming agent, complexone, water-soluble calixarene and water in the following quantitative ratio:2-35% by mass of hydrogen peroxide; 2-20% by mass of a catalyst for decomposing peroxide compounds; 3-10% by mass of complexone; 0.1-5% by mass of surface-active agent; 0.01%-1.0% by mass of anti-foaming agent; 0.01-1% by mass of water-soluble calixarene, with the remainder being water. The technical result is an increase in the effectiveness of action of a solution (degree of cleaning) for cleaning surfaces soiled with deposits having a high content of organic substances, while simultaneously extending the field of use of said solution.

11 Claims, No Drawings

(56) References Cited

U.S. PATENT DOCUMENTS

| | | | | |
|---|---|---|---|---|
| 2008/0042764 | A1* | 2/2008 | Hagino | H03K 3/011<br>331/158 |
| 2011/0166055 | A1* | 7/2011 | Reinhardt | C11D 3/391<br>510/220 |
| 2014/0005091 | A1* | 1/2014 | Reinhardt | C11D 3/3932<br>510/116 |
| 2016/0136627 | A1* | 5/2016 | Rohwer | C11D 3/3917<br>8/137 |

* cited by examiner

SOLUTION FOR REMOVING VARIOUS TYPES OF DEPOSITS FROM A SURFACE

CROSS-REFERENCE TO RELATED APPLICATION

This application is a National stage of International Application No. PCT/RU2018/050154 filed on Dec. 3, 2018, which claims benefit of priority to Russian Application No. 2017146009 filed on Dec. 26, 2017, both of which are incorporated by reference herein.

FIELD OF THE INVENTION

The invention relates to the field of removing various types of deposits from a surface, specifically to cleaning methods for industrial equipment and can be used for removing deposits, such as salt deposits, deposits of a petroleum nature, including asphaltene-resin-paraffin, resin and biological (bacterial) deposits.

BACKGROUND OF THE INVENTION

The closest by the prior art is the solution for surface cleaning from deposits of different nature (application No. 2016114065/02(022114)) comprising hydrogen peroxide, chelating agent and water-soluble calixarene (selected as the prototype) as the main components. This solution efficiently removes deposits of different nature from metal, glass, ceramic and other coatings.

The disadvantage of this invention is low efficiency of cleaning of surfaces contaminated with deposits with high organic content. In addition, the above solution does not comprise anti-foaming agents, thus reducing the scope of its practical application, for example, the known solution is not recommended to use for the equipment with large volumes (from 1 $m^3$) of solutions due to excessive foam formation that can lead to violation of the equipment safety conditions.

There is a known solution for steel and brass surfaces of heat power equipment (SU 1805687 published on 27 May 1995, MPK C23G 1/14, Sverdlovsky Research Institute for Chemical Engineering) comprising, g/l: disodium salt of ethylenediaminotetraacetic acid (Trilon B) 20.0-50.0; hydrogen peroxide 15.0-30.0 and sodium hydroxide 3.5-18.0. This solution efficiently removes iron and copper oxides causing no copper sediments on the equipment surface due to sodium hydroxide content.

The disadvantage of this method is its limited use on the deposits of iron and copper oxide nature, as well as sharp reduction in effectiveness in case of deposits of organic nature.

There is a known invention "Solution for cleaning of facilities from uranium compounds and cleaning method" (RU 2138869 published on 27 Sep. 1999, MPK G21F 9/34, The Babcock & Wilcox Company, US). The invention refers to removal of scale divergence, uranium contamination from the surface. The solution for cleaning the uranium-contaminated units comprises the solvent comprising the ammonium carbonate, hydrogen peroxide and chelating agent selected from the group of carboxylic acids, in certain ratio, wherein the solution having pH of 9-9.5 and additionally comprising the foaming agent. The cleaning method provides for mixing the solution causing its foaming in the reservoir located outside the contaminated unit and fluid related, the foamed solution is supplied by air or inert gas to all cavities of the contaminated unit to make the foam of the solution condense and continuously wet the surfaces treated. The invention provides for efficient removal of uranium contaminations from the surfaces of process equipment and large diameter pipes. The foam cleaning provides for cleaning such surfaces as ducting.

The disadvantage of this method is increased foam formation that is undesirable during chemical treatment of heat-exchange equipment due to possible spread of reagents by foam parts.

There is a known method for use of peroxides with complexing compounds in disinfectant cleaning compositions (RU 2360415 C1, NPP Biokhimmash CJSC (RU) published on 10 Jul. 2009, MPK A01N25/22) consisting in that the complexing agent immobilized hydrogen peroxide for disinfection is used for surface treatment. 1.5 kg mechanically activated chelating agent is mixed with 5 kg peroxide and diluted with 30 l water by adding the surface active agent (SAA).

The disadvantage of this method is its restricted specific application, i.e. use for disinfection only, without metal oxidation inhibitors, and surface treatment complexity.

SUMMARY OF THE INVENTION

The common object of the group of inventions is to create a new composition for efficient cleaning of equipment and product surfaces contaminated with deposits that have a high organic content, in particular, metal and/or non-metal surfaces, for example, ceramic and polymer surfaces.

The common technical result of the group of inventions is an increased efficiency of the cleaning solution (degree of cleanliness) for surfaces deposits of high organic content, with simultaneously increasing application scope.

The novel invention has considerably higher efficiency indicators as compared to the preceding inventions, including those comprising the hydrogen peroxide, as it provides for cleaning from deposits of heavy fractions of hydrocarbons of petroleum production. The feature of these deposits is their inactivity in relation to the chemical agents, that is why, in this invention, the physical effect of peroxide compound decomposition is stronger due to formation of alkaline medium in the working solution simultaneously with the use of the targeted catalyst agents.

The set object and the technical result required are achieved by a solution for removing various types of deposits from a surface, comprising hydrogen peroxide, a chelating agent, an anti-foaming agent, water-soluble calixarene and water at the following quantitative ratio, % wt.:hydrogen peroxide 2-35; catalyst for decomposing peroxide compounds 2-20; chelating agent 3-10; detergent (or surface active agent, SAA) 0.1-5.0; anti-foaming agent 0.01-1.0; water-soluble calixarene 0.01-1.0; water—remaining part. In some embodiments, the water-soluble polyatomic salts of organic acids and phosphonic acid derivatives are used as chelating agents.

The claimed solution comprises alkali metal hydroxides, transition metal compounds or their mixtures as the catalyst for decomposing peroxide compounds.

The claimed solution comprises alkylbenzene sulfonate, nonoxynol, ethoxylated fat alcohol, laureth sulfate and their mixtures as the SAA.

The claimed solution comprises the water-oil emulsion of polydimethylsiloxanes and other silicon organic compounds, as well as the ethylene oxide and propylene oxide-based block copolymers as the anti-foaming agent.

In the other alternative embodiment, the claimed solution further comprises the peroxide compound stabiliser in the amount of 1-5% wt. wherein the sodium hexametaphosphate, potassium phosphate and sodium tripolyphosphate are used as the peroxide compound stabiliser.

In the other alternative embodiment, the claimed solution further comprises the corrosion inhibitor in the amount of 0.5-2.5% wt.

The set object and the technical result required are also achieved by the high-concentration component to produce the above solution comprising chelating agent, water-soluble calixarene and catalyst for decomposing peroxide compounds at the following quantitative ratio, % wt.:chelating agent 30-50; water-soluble calixarene 0.1-10, catalyst for decomposing peroxide compounds 2-20, water—remaining part.

In one of the alternative embodiment, the claimed high-concentration component further comprises the corrosion inhibitor in the amount of 5-25% wt.

In the one more alternative embodiment, the claimed high-concentration component further comprises the peroxide compound stabiliser in the amount of 5-20% wt.

In the one more alternative embodiment, the claimed high-concentration component further comprises the SAA in the amount of 3-30% wt.

In the one more alternative embodiment, the claimed high-concentration component further comprises the anti-foaming agent in the amount of 1-5% wt.

The set object and the technical result required are also achieved by the method of preparation of the solution for cleaning from deposits of different nature, wherein the claimed high-concentration component is mixed with hydrogen peroxide and diluted with water.

The set object and the technical result required are also achieved by the method of surface cleaning with the solution for cleaning from deposits of different nature, including the stage at which the surface indicated comes into contact with the solution claimed according to the invention, wherein the surface indicated is the metal surface or non-metal surface.

The set object and the technical result required are also achieved by the method of surface cleaning from deposits of different nature consisting in combination of mechanical, chemical and physical-chemical effect on the indicated deposits of the components of the cleaning solution produced by the interaction of the high-concentration component comprising, at least, the catalyst for decomposing peroxide compounds, chelating agent and water-soluble calixarene with the hydrogen peroxide and further water dilution that leads to over gassing on the surface and in the pores of the indicated deposits, wherein the indicated surface is a metal surface or non-metal surface.

The background of the claimed cleaning technology is to combine the mechanical and chemical effect on the deposits, as well as combine complexing and surface-active properties in a molecule of the active component (water-soluble calixarene): one is complexing and the other is surface-active. The claimed technology uses the exothermic effect of peroxide compound decomposition with over gassing on the surface and inside the deposits. This effect makes it possible not to heat the cleaning solution, as the decomposition energy is used for these purposes. Also, the use of water-soluble calixarenes in combination with peroxide compounds provides for adsorptive weakening of deposits. Over gassing provides for loosening of deposits and their desorbing from the surface of the equipment and products to be cleaned. In combination with the water-soluble calixarenes that combine both complexing and surface-active properties by which it is possible to form mycelial structures, complete balance shift towards dissolution of deposits, particularly, metal oxides during metal surface cleaning is achieved.

Besides, in the claimed invention, the physical effect of peroxide compound decomposition is stronger due to formation of alkaline medium in the working solution simultaneously with the use of the targeted catalyst agents. This provides for more intense over-gassing on the surface and inside the pores of deposits with formation of bubbles with radius from $1.6*10^{-5}$ m to $2*10^{-3}$ m maintaining the temperature up to 250° C. and pressure from 0.1 to 16 MPa in the local area around deposits to produce effects even to organic deposits inactive in relation to major chemical reagents in combination with the alkaline component detergency.

DETAILED DESCRIPTION OF THE INVENTION

As it was already mentioned above, the background of the claimed cleaning technology is to combine the mechanical, chemical and physical-chemical effect on the deposits, as well as combine complexing and surface-active properties in a molecule of the active component.

The peroxide compound decomposition is associated with excessive gas formation with energy release. The volume of the gas released is proportional to the hydrogen peroxide concentration. The exothermic effect of decomposition provides for solution heating that leads to sped-up effect occurrence and chemical reaction rate directly in the pores of deposits.

The cleaning composition (solution) comprises hydrogen peroxide, catalyst for decomposing peroxide compounds, SAA, chelating agent, water-soluble calixarene, anti-foaming agent and water.

The hydrogen peroxide 2-35% wt. (depending on the initial solution concentration) provides for gas formation processing by exothermic decomposition that, in its turn, has the destructive effect on deposits. Using the composition with the percentage of less than 2% wt. does not provide for necessary effect (incomplete cleaning), using the composition with the percentage of more than 35% wt. is not recommended as in this case the intense decomposition effect can have destructive effect on the equipment. The hydrogen peroxide concentration affects the gas volume and temperature in the pores of deposits. By changing the peroxide component concentration, the specified gas formation intensity is achieved.

The catalyst for decomposing peroxide compounds in the amount of 2.0-20.0% wt. (depending on the initial solution concentration), in case of use of alkali metals as hydroxides, provides for necessary pH of the solution, has the destructive effect on organic deposits and passivates metal surfaces. For extra complex deposits, the cleaning composition can further comprise the catalyst for decomposing peroxide compounds in the form of transition metal compounds, for example, copper, iron, chrome, nickel, manganese ions, etc.

Besides, the transition metal compounds can be used as the catalyst for decomposing peroxide compounds beyond the combination with alkali metal hydroxides, with the cleaning efficiency preserved. Also, the use is possible, for example, in cases, when the use of the solutions with alkali components is hindered by the nature of the equipment material. Thus, for example, aluminium alloys are subject to severe destruction, that is why to use the composition for the equipment made of this material, the transition metal catalysts are used. And maintaining the efficiency of cleaning is achieved by maintaining the catalytic decomposition of peroxide compounds in the pores of deposits.

The water-oil emulsion of polydimethylsiloxanes and other silicon organic compounds, ethylene oxide and propylene oxide-based block copolymers are used as the anti-foaming agents in the amount of 0.01-1.0% wt. Using the anti-foaming agents in the amount of 0.01% wt. does not provide for foam and foam formation decrease, and of more than 1% wt. does not affect the anti-foaming rate. Presence of such component as the anti-foaming agent in the claimed solution makes it possible, as opposed to the prototype, to use the solution for the facilities with large volumes (from 1 $m^3$) of solutions because of possible violation of the facility safety conditions.

The claimed solution comprises the SAA in the amount of 0.1-5% wt. to ensure better wetting quality of the equipment surface, provide for deeper penetration of the solution into the pores of deposits and emulsification of organic deposits in the solution.

The non-ionic surfactants—alkoxylates, alkyl glycosides, anionic surfactants—carboxyethoxylates, phosphates and polyphosphates, sulphosuccinates, alkyl sulfates, alkyl ester sulfates. The use of surfactants (SAA) provides for further increase in cleaning efficiency of the solution due to the decreased surface tension at the interface of the fluid and solid matter phases (cleaning solution—deposits). This effect is due to the SAA molecule sorption on the surface of deposits and due to the similarity of chemical nature of the deposits molecules and SAA molecules. The decreased surface tension provides for better wetting quality of deposits by the cleaning composition that entails the increased contact area of the solution with deposits. Besides, the above effect makes the solution penetrate into the pores of deposits that leads to possible delivery of peroxide compounds to the pores of deposits with further decomposition. The selection of the surface-active agent is the important task to be solved individually depending on the nature of deposits. The use of the SAA in the concentrations of less than 0.1% does not provide for wetting effect, and of more than 5% does not influence the further increased cleaning efficiency.

The chelating agent is used in the amount of 3-10% wt. The water-soluble chelating agents, for example, sodium salts of overbased organic acids or overbased organic acid themselves, such as complexone 2, as well as phosphonic acid derivatives, such as ATM, etidronic acid, can be used as the chelating agent. The use of the chelating agent in the concentration of less than 3% wt. does not provide for necessary complexing effect, and in the concentration of more than 10% wt, the composition cost increase is not compensated by the increased detergency effect (the composition is deteriorated by the "efficiency-cost" criterion).

The water-soluble calixarene of general formula is used in the amount of 0.01-1.0% wt. The compound of general formula is preferably used

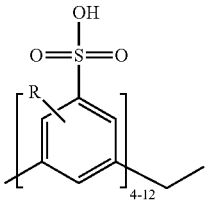

The use of the water-soluble calixarenes of the structure specified provides for efficient binding of heavy ions, including radioactive ones, thus forming stable complexes. Any structures of the content specified can be used. For heavy metal binding, the compounds with the number of monomer units of 6-8 are preferred, as in this case, the internal cavity of the molecule matches the heavy metal radius. The use of the water-soluble calixarenes in the concentrations less than 0.01% wt. does not provide for complexing effect, and with the increased concentration (more than 1.0% wt.), no improvement in cleaning properties is observed.

The use of the water-soluble calixarenes that combine both complexing and surface-active properties provides for considerable increase in the cleaning efficiency. In particular, in case of metal surfaces, metal ion binding and transition to mycelial phase occur (it was not claimed earlier).

As the universal complexing agent, the use of tetracarboxylic based compounds, for example, EDTA and its salts is the most optimal. These examples of specific acids are given for illustration of embodiment of the group of inventions and do not restrict the scope. These examples of acids should not be considered as restricting the scope of the claimed group of inventions that is determined by the claims.

The peroxide compound stabiliser can be further added in the amount of 1-5% wt. Sodium hexametaphosphate or similar salts of phoshoric and polyphoshoric acids, such as sodium tripolyphosphate, are used as such stabiliser. With the use of the stabiliser in the concentration of less than 1% wt., the decomposition occurs incrementally and is not controllable, and of more than 5% wt., no proper gas formation is provided. The gas release rate during the peroxide compound decomposition is primarily dependent on the concentration ratio of stabiliser and catalyst for decomposing peroxide compounds.

To neutralize the destructive effect of the cleaning composition, the relevant inhibitor in the amount of 0.5-2.5% wt. are further applied directly on the equipment surface. These substances form the non-soluble solid layer on the surface to protect it from exposure of the solution active components. The use of inhibitor in the concentrations of less than 0.5% wt. does not provide for proper inhibiting effect, and with the concentration of more than 2.5% wt., leads to the unjustified composition cost increase. Captax (2-mercaptobenzothiazole), benzotriazole, tolyltriazole (4-methyl-benzotriazole and 5-methyl-benzotriazole mixture), pyridinic and pyridinic based compound can be used as corrosion inhibitors.

The detergency effect is achieved by the cleaning composition pumping through the equipment contours or by placing the parts into the bath with circulation.

To justify the assay content of reagents in the aqueous solution, for cleaning the metal and non-metal surfaces from deposits, the illustrative samples (see Table 1) that had passed the cleaning efficiency testing were prepared.

TABLE 1

Examples (samples) of cleaning solutions.

| Content, | Examples | | | | | | | | | |
|---|---|---|---|---|---|---|---|---|---|---|
| % wt. | 1 | 2 | 3 | 4 | 5 | 6 | 7 | 8 | 9 | 10 |
| Hydrogen peroxide | 1 | 25 | 30 | 5 | 15 | 30 | 5 | 15 | 30 | 30 |

TABLE 1-continued

| Content, % wt. | Examples (samples) of cleaning solutions. Examples 1 | 2 | 3 | 4 | 5 | 6 | 7 | 8 | 9 | 10 |
|---|---|---|---|---|---|---|---|---|---|---|
| Sodium hydroxide (catalyst for decomposing peroxide compounds) | 0 | 0 | 5 | 5 | 10 | 10 | 15 | 15 | 30 | 40 |
| EDTA | 4 | 4 | 6 | 15 | 4 | 6 | 20 | 30 | 5 | 10 |
| Anti-foaming agent | 0.05 | 0.01 | 0.05 | 0.01 | 0.1 | 0.1 | 1 | 0.5 | 1 | 0.5 |
| SAA | 0 | 0.1 | 0.1 | 1 | 1.5 | 2 | 2 | 3 | 5 | 7 |
| Water-soluble calixarene | 5 | 2 | 0.01 | 5 | 0.1 | 0.1 | 3 | 0.1 | 0.1 | 0.1 |
| Water | remain. | remain. | remain. | remain. | remain. | remain. | remain. | remain. | remain. | remain. |

To produce the solution (sample) according to example 1, the high-concentration component comprising the chelating agent (EDTA), sodium hydroxide and water-soluble calixarene (6 monomer units), was mixed with 36% hydrogen peroxide solution and diluted with water. The produced cleaning solution comprised the following components: hydrogen peroxide, sodium hydroxide, EDTA, water-soluble calixarene, SAA, anti-foaming agent (water-oil emulsion of polydimethylsiloxanes) and water. The produced solution was pumped through the heat exchanging equipment contaminated with oil residues (thermal decomposition products of heavy hydrocarbon fractions). Purity test was conducted by the visual method and pressure difference method upstream and downstream heat exchanger. The cleaning efficiency test results are given in Table 2.

TABLE 2

| Indicators of cleaning of the equipment with organic deposits | | Cleaning efficiency test results for solution samples. Examples, No. of compositions according to present invention 1 | 2 | 3 | 4 | 5 | 6 | 7 | 8 | 9 | 10 |
|---|---|---|---|---|---|---|---|---|---|---|---|
| Presence of deposits after cleaning, % to area | Present invention | 5 | 0 | 0 | 0 | 0 | 0 | 0 | 0 | 0 | 0 |
| | Prototype | 10 | 20 | 30 | 10 | 10 | 20 | 15 | 10 | 20 | 30 |
| Cleaning time, h | Present invention | 6 | 6 | 6 | 6 | 6 | 6 | 6 | 6 | 6 | 6 |
| | Prototype | 8 | 8 | 8 | 8 | 8 | 8 | 8 | 8 | 8 | 8 |
| Aggressive action of the solution on the metal | Present invention | no | no | no | no | no | no | no | no | no | no |
| | Prototype | Partial | no | no | no | no | no | Partial | no | no | no |

In the first example, the presence of residual deposits made 5%, as in such solution, the peroxide compound content is not sufficient to complete the reaction (in this example, the content is 1%, and in the remaining ones, it is more).

Solutions according to examples 1-10 were obtained similarly to example 1. With the only difference that:

as the chelating agent, according to example 2, the ATM was used; according to example 3, the EDTA; according to example 4, the EDTA; according to example 5—the ATM; according to example 6, the etidronic acid; according to example 7, the EDTA, according to example 8, the EDTA; according to example 9, the etidronic acid; according to example 10, the ATM;

as the catalyst for decomposing peroxide compounds, the sodium hydroxide was used in examples 3-10;

as the SAA, in example 4, alkylbenzene sulfonate was used; in example 5—alkylphenol polyethoxylate surfactants (APnEO, n=7-9), in example 6—laureth sulfate, in example 7—APnEO (n=10-12), in example 8—alkylbenzene sulfonate and laureth sulfate mixture 1:1, in example 9—alkylbenzene sulfonate, in example 10—alkylbenzene sulfonate and APnEO (n=10-12) mixture.

as the anti-foaming agent, in examples 1-5 the water-oil emulsion of polymethylsiloxane was used, in examples 6-10—the ethylene oxide-based block copolymers The solutions obtained according to examples 2-10 were tested and assessed in a similar way according to example 1.

The conducted tests are confirmed by the increased efficiency of the claimed solution for cleaning from deposits of organic nature which feature is inactivity in relation to chemical agents with simultaneously increasing scope.

Although this group of invention has been described in detail in the examples of embodiments that appear to be preferred, it should be remembered that these examples of embodiment are given only for illustrative purposes. This description should not be considered as restricting the scope of invention, as the described solution, its high-concentration component, method of preparation and cleaning method can be modified by those skilled in the art of chemistry, etc., in order to adopt them to specific solution contents or situations and not to be beyond the appended claims of group of inventions. Those skilled in the art are aware that variations and modifications, including equivalent solutions, defined by the claims are possible within the scope of the invention.

The invention claimed is:

1. A solution for removing various types of deposits from a surface, the solution comprising hydrogen peroxide, a catalyst for decomposing peroxide compounds, a chelating agent, a surfactant, an anti-foaming agent, water-soluble calixarene and water at the following % by wt.:

| | |
|---|---|
| hydrogen peroxide | 2-35 |
| catalyst for decomposing peroxide compounds | 10-20 |
| chelating agent | 3-10 |
| surfactant | 0.1-5 |
| anti-foaming agent | 0.01-1.0 |
| water-soluble calixarene | 0.01-1 |
| water | remaining part; |

wherein the catalyst for decomposing peroxide compounds is an alkali metal hydroxide, and the surfactant is selected from the group consisting of alkylbenzene sulfonate, branched nonylphenol ethoxylate, ethoxylated fat alcohol, laureth sulfate, and a mixture thereof.

2. The solution according to claim 1, further comprising a peroxide compound stabiliser in the amount of 1-5% wt.

3. The solution according to claim 1, further comprising a corrosion inhibitor in the amount of 0.5-2.5% wt.

4. The solution according to claim 1, wherein the chelating agent is selected from the group consisting of polyatomic salts of organic acids and phosphonic acid derivatives.

5. The solution according to claim 1, wherein the anti-foaming agent is selected from the group consisting of water-oil emulsion of polydimethylsiloxanes, silicon organic compounds, ethylene oxide and propylene oxide-based block copolymers.

6. A high-concentration component for preparation of a solution for removing various types of deposits from a surface, comprising, at least, a chelating agent, water-soluble calixarene, a catalyst for decomposing peroxide compounds and water at the following % by wt.:

| | |
|---|---|
| chelating agent | 30-50 |
| water-soluble calixarene | 0.1-10 |
| catalyst for decomposing peroxide compounds | 10-20 |
| water | remaining part; |

wherein the catalyst for decomposing peroxide compounds is an alkali metal hydroxide.

7. The high-concentration component according to claim 6, further comprising a corrosion inhibitor in the amount of 5-25% wt.

8. The high-concentration component according to claim 6, further comprising a peroxide compound stabiliser in the amount of 5-20% wt.

9. The high-concentration component according to claim 6, further comprising a surfactant in the amount of 3-30% wt.

10. The high-concentration component according to claim 6, wherein the chelating agent is selected from the group consisting of polyatomic salts of organic acids or phosphonic acid derivatives.

11. A method for cleaning a surface from deposits of various nature, comprising applying on the deposits a solution produced by mixing a high-concentration component and hydrogen peroxide with further dilution with water to provide over-gassing on deposits' surface and inside pores of the deposits with formation of bubbles with radius from $1.6*10^{-5}$ m to $2*10^{-3}$ m, while maintaining temperature up to 250° C. and pressure from 0.1 to 16 MPa in an area around the deposits, wherein the high-concentration component comprises, at least, a chelating agent, a water-soluble calixarene, a catalyst for decomposing peroxide compounds and water at the following ratio, % wt.:

| | |
|---|---|
| chelating agent | 30-50 |
| water-soluble calixarene | 0.1-10 |
| catalyst for decomposing peroxide compounds | 10-20 |
| water | remaining part; |

wherein the catalyst for decomposing peroxide compounds is an alkali metal hydroxide.

* * * * *